United States Patent [19]

Zarges et al.

[11] 3,949,683

[45] Apr. 13, 1976

[54] COLLAPSIBLE SHELF ARRANGEMENT

[75] Inventors: Walther Zarges, Murnau, Oberbayern; Frank Zarges, Socking, Oberbayern, both of Germany

[73] Assignee: Walther Zarges, Germany

[22] Filed: July 12, 1974

[21] Appl. No.: 488,210

[30] Foreign Application Priority Data

July 12, 1973 Germany ..... 2335381

[52] U.S. Cl. ..... 108/111

[51] Int. Cl.[2] ..... A47B 3/00

[58] Field of Search ..... 108/111, 115

[56] References Cited

UNITED STATES PATENTS 3,099,356 7/1963 Bubnett ..... 108/111

3,492,953 2/1970 Busse et al. ..... 108/111

*Primary Examiner*—James C. Mitchell

*Attorney, Agent, or Firm*—Craig & Antonelli

[57] ABSTRACT

A collapsible shelf arrangement with at least two supporting panels or trays and two frame sections pivotable with respect to each other. A locking arrangement is provided for securing the panels or trays against automatic collapse. To collapse the shelf arrangement, one of the supporting panels or trays is lifted, whereas, to set up the shelf, another panel is lifted and positioned to automatically lock the entire arrangement.

38 Claims, 13 Drawing Figures

COLLAPSIBLE SHELF ARRANGEMENT

The present invention relates to a collapsible shelf arrangement which includes at least two supporting panels or the like and two frame sections pivotable with respect to each other so that the supporting panels or the like are arranged, in the set-up condition as well as in the collapsed condition, in essentially parallel planes. Each supporting panel or the like is pivotally mounted to one of the frame sections and rests, in the set-up condition of the shelf, on stops or abutments of the other frame section.

Conventional shelf construction, for example of the type disclosed in Swiss Pat. No. 474,234, have the disadvantage that the collapsing of a set-up shelf may be effected by compressing the frame sections bearing the supporting trays or the like so that there is danger of an undesired collapse of the shelf in case one of the frame sections meets a resistance, for example, a threshold between two rooms and/or a wall. Additionally, during the folding up of this shelf arrangement, one must overcome not only the resistance of a spring, but also the resistance of trunnions guided in partially obliquely oriented guide slots. A further disadvantage resides in the fact that the space requirement for a collapsed shelf of this type is relatively large. Furthermore, these shelves, also called serving tables, can be lifted but in so lifting it is necessary to take care that none of the frame sections is pivoted by hitting some object because the entire shelf arrangement then collapses and the supporting panels are tilted so that articles disposed on the panel or tray slide off thereby increasing the danger of accident.

Furthermore, in German Published Application No. 1,258,049, a foldable table is disclosed which can also be used as a shelf arrangement and which includes at least one intermediate plate connected by a supporting levers or mounting brackets with the frame sections in a hinged coupling. The supporting levers or mounting brackets are displacably arranged at the intermediate plate or at the frame sections. Such a table or corresponding shelf arrangement is relatively thin in the collapsed condition since the intermediate plate and/or plates are disposed within the frame sections. However, a disadvantage of this type of construction resides in the fact that the intermediate plate must be secured against unintended displacement in the in-use and/or collapsed condition.

In German Pat. No. 6,919,448[u], foldable serving carts and/or folding tables are disclosed wherein the supporting panels or the like are respectively pivotably mounted to one of the frame sections which are articulated together in a substantially X-shape. In this type construction in the set-up condition of the cart or table, hooks provided at the supporting panels which extend behind the legs of the rods or the like join the frame sections together. However, in this type of construction, there is danger of collapse of the shelf or the like if one of the frame sections meets with a resistance because the shelf is folded up by moving the two frame sections into one plane about their pivot axis.

Accordingly, it is an object of the present invention to provide a collapsible shelf arrangement which avoids the aforementioned shortcomings and drawbacks encountered in the prior art.

Another object of the present invention resides in providing a collapsible shelf or table arrangement which prevents an automatic collapse when hitting an object such as a threshold wall or the like.

Still another object of the present invention resides in a collapsible shelf arrangement which may readily be collapsed and set-up without any difficulties.

According to one feature of the present invention a shelf arrangement or the like is provided which can be collapsed by lifting one supporting panel or tray and can be set-up again by lifting another panel or tray. Additionally a locking arrangement is provided which secures the shelf arrangement against automatic collapse, for example, when hitting another object such as a threshold, a wall, or the like.

According to a further feature of the present invention the shelf arrangement is provided which in the collapsed condition does not occupy more space than corresponds approximately to twice the thickness of a frame section of the shelf arrangement or one panel.

According to still a further feature of the present invention a locking arrangement is provided whereby it is possible to lift the entire shelf arrangement at least at an upper supporting panel without collapsing the same.

According to the present invention at least one of the supporting panels is provided with a locking means to prevent the collapse of a set-up shelf which locking means, by pivoting the supporting panel into the operative condition, automatically locks this panel into position.

The present invention provides the other supporting panel with locking means which can be released only once the first mentioned supporting panel or the like has been pivoted with the purpose of intentionally collapsing the shelf. This latter arrangement makes it possible to collapse the shelf arrangement of the present invention from its set-up condition in a maximally simple manner by pivoting the first-mentioned panel.

According to a further feature of the present invention, if the two frame sections of the shelf arrangement are arranged essentially in a vertical plane, it is merely necessary to lift the lowest positioned side edge of the other supporting panel to set up the frame. Thus, the handling, i.e. the set up and collapsing of the shelf, is substantially simpler than the prior art constructions in that only one of the supporting panels needs to be manipulated to collapse and to set-up a folded shelf arrangement. Additionally, the shelf can be carried and also moved in the set-up condition whether or not it carries a load without a danger of inadvertent collapse.

Preferably, one of the panels, pivotally mounted to a frame section, can be guided with respect to the other frame section by means of a pair of guide rods and the other panel pivotally mounted to another frame section can be guided by bolts engaging in linear guides mounted to the panel in parallel to the panel plane and fixed to the other frame section.

In a further embodiment the bolts engaging in the linear guides of the other panel serving to control the setting up of a folded shelf are connected to the frame section at which the other supporting panel is mounted by way of at least one guide rod. According to the present invention it is also possible to articulate the pair of guide rods directly to the last-mentioned supporting panel.

In yet another embodiment of the present invention more than two supporting panels are provided in the shelf arrangement with these panels mounted to one frame section and joined to the other frame section by way of guide rods so that the further panels are controlled by the movements of the other panels or trays. In this latter arrangement, it is also possible to connect at least two panels by means of guide rods or the like so that when one panel is moved the other is likewise displaced.

These and other objects, features, and advantages of the present invention will become more apparent from the following description when taken in connection with the accompanying drawings which show, for the purposes of illustration only, several embodiments of a folding shelf arrangement in accordance with the present invention, and wherein:

FIG. 4 is a schematic side view depicting the articulation of further panels to the frame sections via respective pairs of guide rods or the like;

Figure 1:
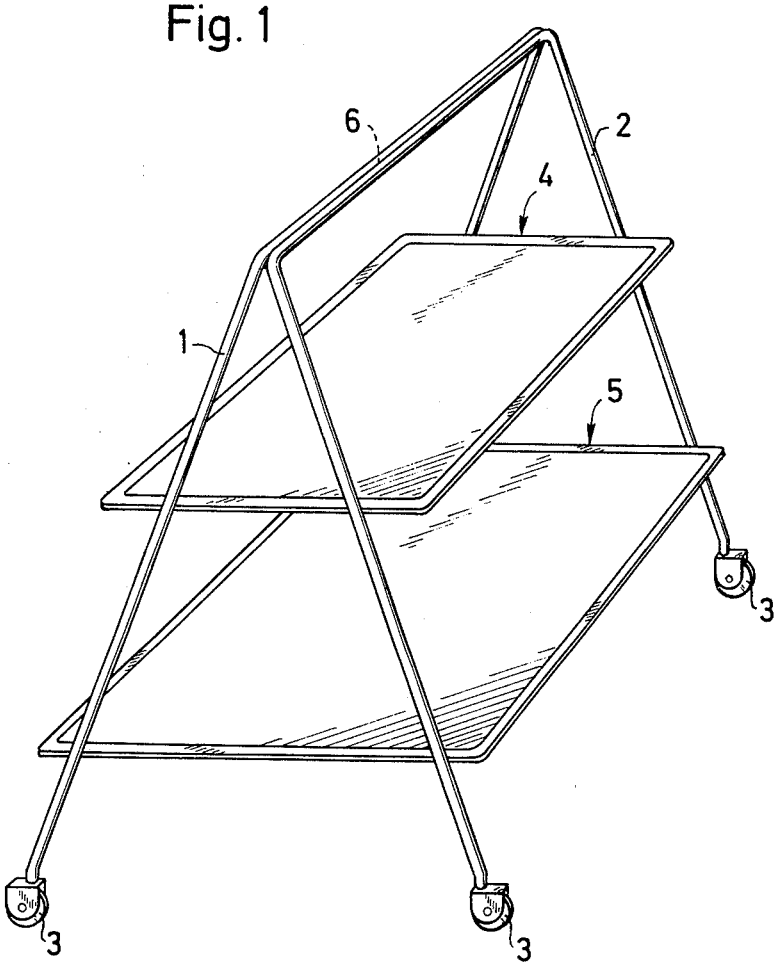
FIG. 1 is a perspective view of a shelf made up of two mutually pivotable frame sections having mounted thereon two supporting panels or trays.

Referring now to the drawings wherein like reference numerals are used thoughout the various views to designate like parts and more particularly to FIG. 1, wherein a shelf arrangement is provided consisting of two frame sections 1, 2 associated with rollers or the like 3 and two supporting panels or trays 4, 5. The frame sections 1, 2 consist of tubes or the like bent into a substantially U-shape which are pivotable with respect to each other about a horizontal axis 6.

Figure 2:
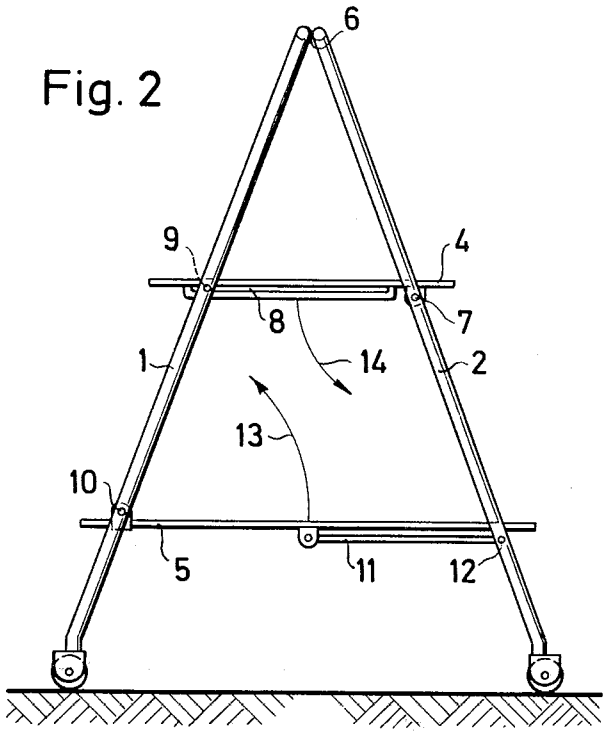
FIG. 2 is a schematic side view of a shelf arrangement constructed in accordance with the present invention with two supporting panels, both of which are pivotably mounted to different frame sections and which are locked in the set-up condition against collapse by a pair of guide rods and by linear guides.

As shown in FIG. 2, the supporting panel 4 is mounted to the frame section 2 so as to be pivotable about a pivot axis 7 disposed beneath the supporting panel. Additionally, the supporting panel 4 is provided with a linear guide means 8 which is engaged by bolts 9 fixedly attached to the legs of the frame section 1. The linear guide means extends in parallel to the plane of the panel 4 and into the proximity of the pivot axis 7 of the supporting panel 4.

The supporting tray or panel 5 is pivotable at the frame section 1 about a pivot axis 10 disposed above the plane of the supporting panel 5. Approximately in the center of the two parallel sides of the supporting panel 5, guide rods 11 are hingedly joined to the supporting panel beneath the latter. The other ends of these guide rods are movable about a pivot axis 12 disposed in the plane of the frame section 2 and extending, in the set-up condition of the shelf arrangement, in the horizontal direction.

By the arrangement of FIG. 2, if one of the frame sections 1 or 2 meets with a resistance, for example, a threshold, door sill, or a wall, the guide rods 11 block the supporting panel or tray 5 thereby preventing the shelf arrangement from collapsing. However, in order to be able to fold the shelf arrangement, the supporting tray must be pivoted in the direction of arrow 13. This pivoting action can be effected, for example, by seizing the supporting panel 5 at its surface segment extending beyond the frame section 2 thereby reducing the angle between the two frame sections 1, 2 whereby the bolts 9 provided at the frame section 1 slide in the linear guide means 8 until the supporting panel or tray 4 arrives in the plane of the frame section 1.

In lieu of such linear guide means 8 with bolts 9, it is also possible to provide twin guide rods which, in the set-up condition of the shelf arrangement, extend in parallel through the frame section 1 as will be discussed further hereinbelow.

To set up the collapsed shelf arrangement of FIG. 2, it is merely necessary to lift the surface segment of the supporting panel or tray 4 projecting toward the left hand side beyond the frame section 1, as shown in FIG. 2. By this lifting of the surface segment, the bolts 9 slide along in the linear guide means 8 and the supporting panel or tray 5 is automatically pivoted into a horizontal plane with the shelf arrangement thereby being set-up and locked in position.

Figure 3:
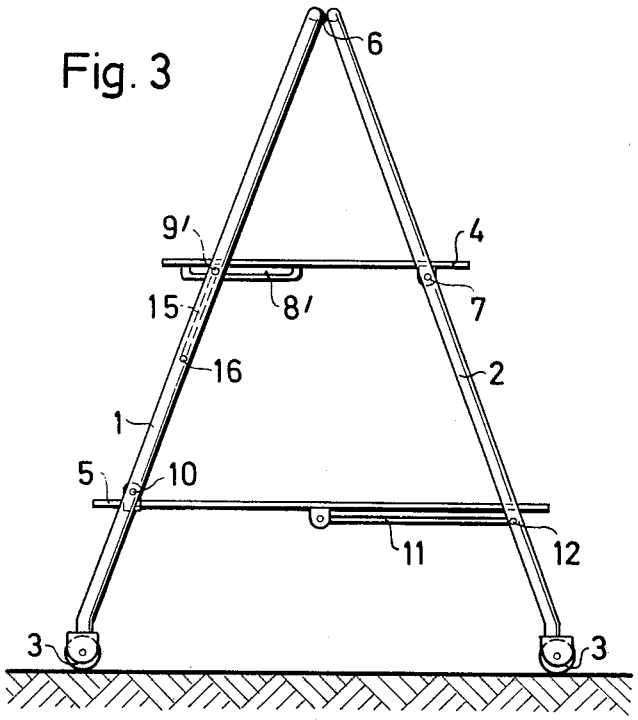
FIG. 3 is a schematic side view similar to FIG. 2 wherein the linear guide of the upper supporting panel is engaged by guide rods or the like which, in the set-up condition of the shelf, extend in parallel to the frame section to which the guide rods or the like are articulated.

FIG. 3 illustrates a further embodiment of the present invention in which the linear guide means 8′ are fashioned to be shorter than the guide means 8 of the embodiment of FIG. 2 with bolts 9′ being provided for engaging in the linear guide means 8′. The bolts 9′ are mounted to guide rods 15 pivotable at the frame section 1 about the pivot axis 16 disposed beneath the plane of the supporting panel 4. In this embodiment, the bolts 9′ are fixedly attached to the upper ends of the guide rods 15. If the guide rods 15 are made to be somewhat longer than that shown in FIG. 3, then the bolts 9′ can engage into bearings (not shown) fixedly provided beneath the supporting panel or tray 4. Additionally, the guide rods 15 are mounted so that in the set-up condition of the shelf arrangement, these rods extend in parallel to the frame section 1. Since the panel or tray 4 of the embodiment of FIG. 3 is, in the set-up condition of the shelf arrangement, locked in position just as the panel 4 of the embodiment of FIG. 2, the entire shelf arrangement can be carried by lifting the panel 4 without the danger of collapse of such shelf arrangement since, in both cases, the locking of the supporting panel 5 by the pairs of guide rods 11 prevents such a collapse. However, if it is desired to fold the shelf arrangement of FIG. 3, the supporting panel 5 must be seized, as in the embodiment of FIG. 2, at the surface segment projecting beyond the frame section 2.

Figure 5:
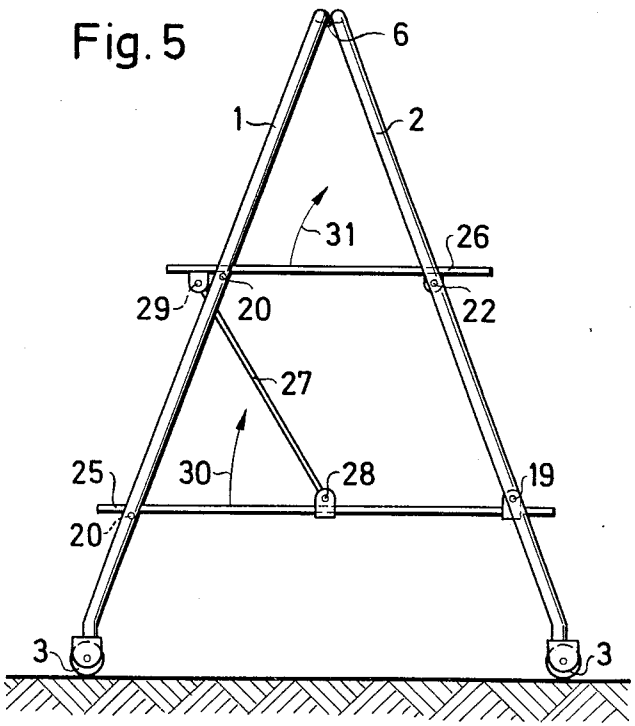
FIG. 5 is a schematic side view depicting the articulation of additional panels by means of a guide rod pair engaging one of the supporting panels.
Figure 4:
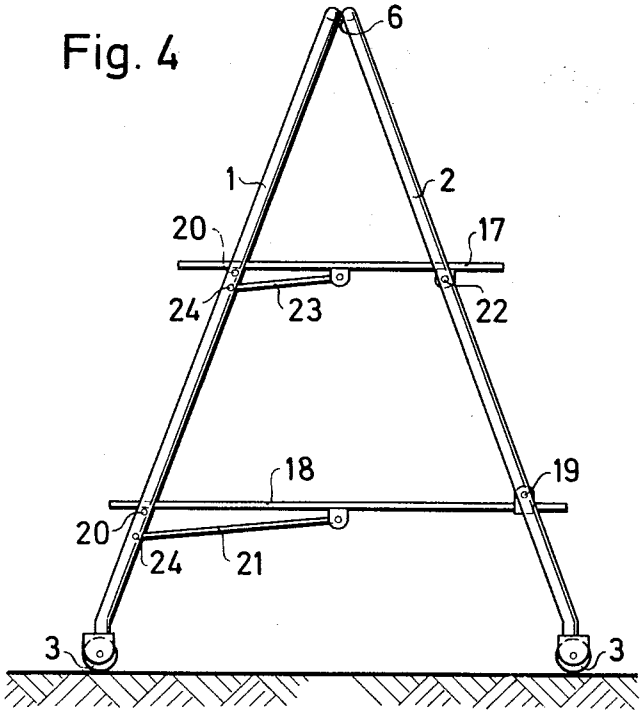

FIGS. 4 and 5 schematically illustrate further embodiments of the present invention and demonstrate how additional supporting panels, trays, or the like can be provided at the frame sections 1, 2 so that they are pivoted together with the supporting panels 4 and 5.

In FIG. 4, two additional supporting panels 17, 18 are associated with the shelf arrangement and are controlled in their movement and locked in position by the supporting panels or trays 4, 5 of FIG. 2 or 3, which supporting panels 4, 5, for the sake of clarity, are not shown in FIG. 4. If the correspondingly locked supporting panel or tray 5 of FIG. 2 is lifted, the frame section 1 moves toward the frame section 2 whereby the panel 17 is likewise lifted since it is pivotable about the pivot axis 22 of the frame section 2 and the central portion of this panel 17 is articulated at 24 to the frame section 1 by way of guide rods 23. Additionally, suitable stops or abutments 20 are provided upon which the additional supporting panels or trays 17, 18 rest when the shelf arrangement is in its set-up condition.

The embodiment of FIG. 5 provides a different solution for connecting a further supporting panel or the like with a supporting panel 25 which is to be locked in the set-up condition of the shelf arrangement. In FIG. 5, the locking means for the supporting panel or tray are not illustrated in connection with the supporting panel 25 for this illumination is only to show how an additional supporting panel 26 can be joined to the supporting panel 25 and locked according to this invention so that such additional panel 26 can be automatically pivoted together with the other supporting panel 25 during the collapsing or setting up of the shelf arrangement.

As shown in FIG. 5, bars or the like 27, fashioned to be lockable are provided as connecting elements between the panel 25 and the panel 26. One end of these bars 27 is articulated to the panel 25 in the central zone thereof to be pivotable about a pivot axis 28, and the other end of each of these bars 27 is articulated to the supporting panel 26 to be pivotable about a pivot axis 29. When the supporting panel 25 is pivoted in the direction of arrow 30, the panel 26 is also pivoted together therewith in the direction of arrow 31.

In the shelf arrangements of the present invention described hereinabove, a unilateral loading of the individual panels or trays can not lead to an inadvertent collapse of the shelf arrangement either since a collapsing of the shelf arrangement is only possible if a specific panel, namely, the panel or tray 5 or 25, which is lockable, is lifted. These panels 5 or 25 are arranged, according to the present invention, in a zone of the shelf arrangement which is not readily accessible, for example, these panels are only griped if it is intended to fold the shelf together.

Of course it is to be understood that the various features of the embodiments described hereinabove can be readily combined with one another in as much as the basic idea of this invention is clearly defined in each of the various embodiments as demonstrated by the embodiments illustrated in FIGS. 6–13 each of which provide additional constructional possibilities according to the present invention.

Figure 6:
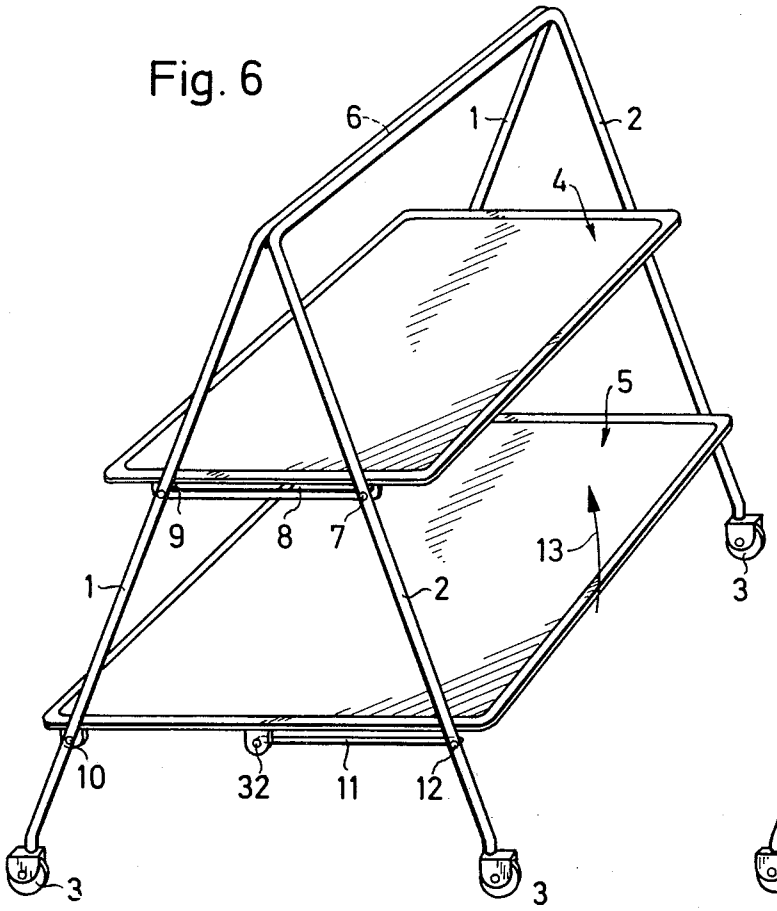
FIG. 6 is a perspective view of a shelf arrangement of FIG. 1 with locking means according to the present invention.

The embodiment of FIG. 6 essentially corresponds to the embodiment of FIG. 2 since, when the lower panel 5 is pivoted in the direction of arrow 13, the panel 5 is pivoted about the pivot axis 10 since the guide rods 11 are pivotably articulated not only about the pivot axis 12 at the frame section 2 but also in the central zone of the supporting panel 5 about the pivot axis 32.

Figure 7:
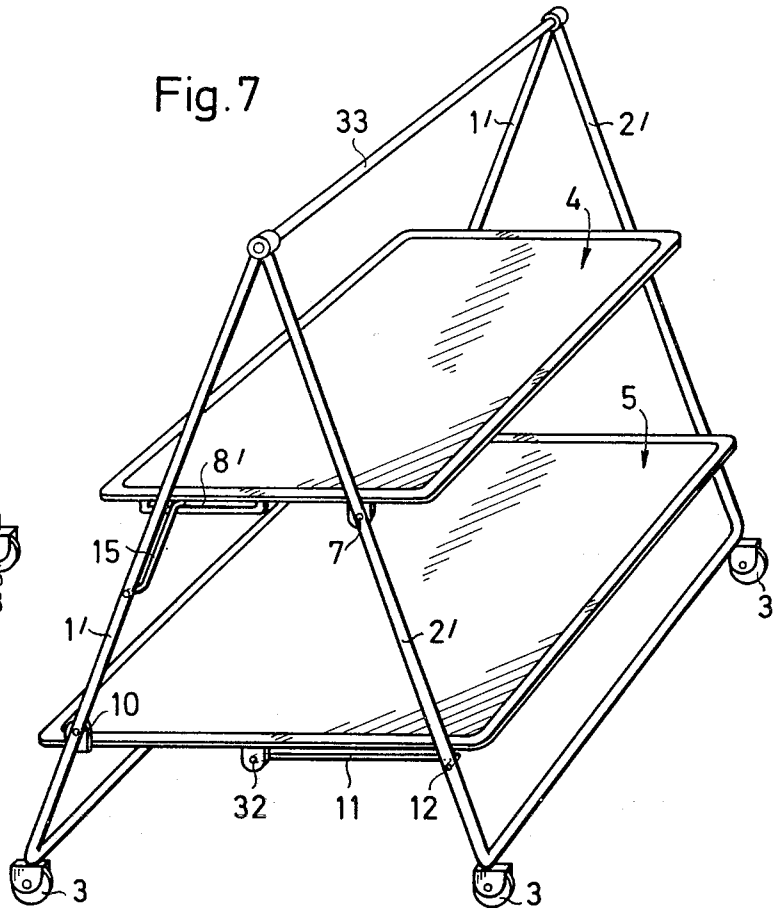
FIG. 7 is a perspective view of the shelf arrangement schematically depicted in FIG. 3.

While, according to FIGS. 1 and 6, the frame sections 1, 2 consist of pipes or tubes bent in a substantially U-shape with the pivot axis 6 being arranged in the zone thereof, according to the present invention, frame sections 1′, 2′, shown in FIG. 7, bent into a substantially U-shape, are joined together by means of a bar or the like 33 so that the cross pieces of these bent pipes are disposed in the zone of the rollers or the like 3 which are fashioned as guide rollers. Additionally, as also shown in FIG. 3, the upper panel or tray 4 is joined to the frame section 1′ by way of linear guides 8′ and guide rods 15.

Figure 8:
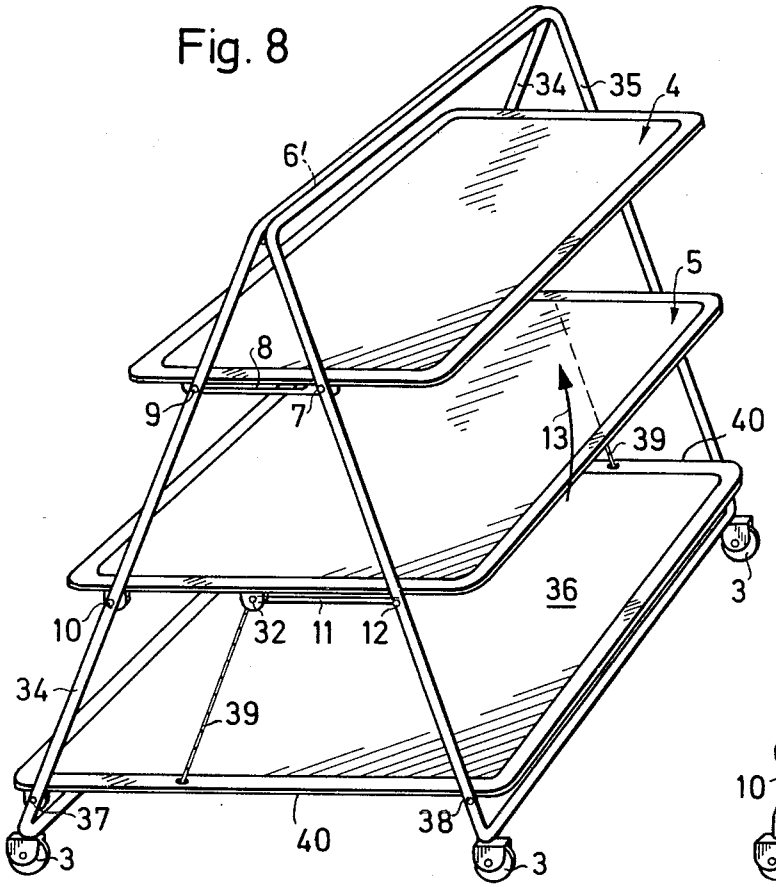
FIG. 8 is a perspective view of a shelf arrangement similar to FIG. 2 with an additional supporting panel or tray.

The embodiment according to FIG. 8 corresponds essentially, with respect to panels 4, 5, to the embodiment of FIGS. 2 and 6; however, as shown in FIG. 8, the panels 4, 5 are disposed at a higher level than the panels of FIGS. 2 and 6 since the frame sections have a larger height and are constructed in this case as frames 34, 35. Additionally, in this latter embodiment a further supporting panel or tray 36 is provided between the frame sections 34, 35. A supporting panel or tray 36 is mounted to be pivotable about a pivot axis 37 of the frame 34 and rests, in the set-up condition of the shelf, on abutments 38. The supporting panel 36 is joined to the lockable supporting panel or tray 5 by way of cables or the like 39. Alternatively, guide rods (not shown) may be employed to join the supporting panel 36 to the tray 5.

To fold the shelf arrangement of FIG. 8, the panel or tray 5 is lifted in the direction of arrow 13 so that it is moved about the pivot axis 10 thereby entraining the two panels or trays 4, 36. The cables or the like 39 are mounted in the zone of the pivot axis 32 of the guide rods 11 and approximately on the two parallel sides 40 of the further panel or tray 36 and extend in parallel to the legs of the frame 34. Abutments on which the supporting panel 5 rests, in the zone of the pivot axis 12 of the frame 5, in the set-up condition of the shelf arrangement are not visible in FIG. 8.

Figure 9:
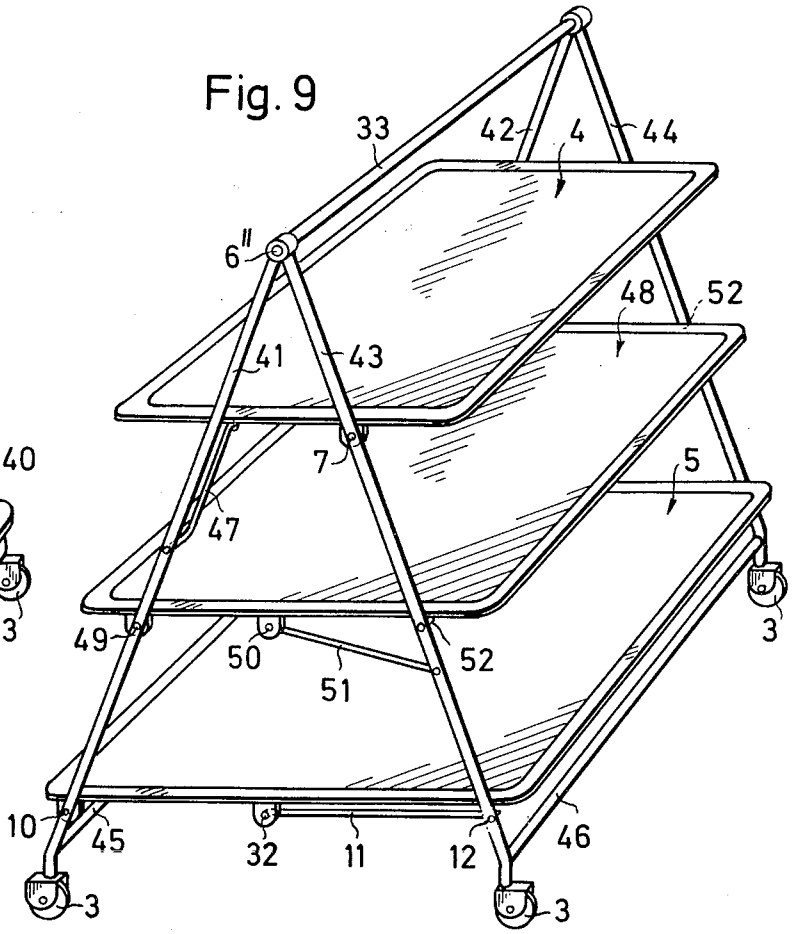
FIG. 9 is a perspective view of a shelf arrangement similar to FIG. 3 with a further supporting panel or tray.

According to the embodiment of FIG. 9, the frame sections consist of individual tubes or the like 41–44 of which the tubes 41 and 42 are joined by a cross tube or the like 45 with the tubes 43, 44 being joined by a cross tube or the like 46 into a rigid unit. The pivot axis 6″ is formed by a bar 33, similar to the bar described in connection with the embodiment of FIG. 7. The panel 4, pivotable about a pivot axis 7, is hingedly joined to the frame section 41, 42, 45 by way of guide rods or the like 47 which are somewhat longer than the guide rods 15 of the embodiment illustrated in FIG. 3 and which are directly articulated to the panel 4 and the frame section 41, 42, 45.

As also shown in FIG. 9, the supporting panel 5 is disposed at a relatively low level and can be lifted from the illustrated position about the pivot axis 10. The supporting panel 5 is connected with the frame section 43, 44, 46 by way of guide rods 11 and rests, in the zone of the pivot axis 12, on guide rods (not shown).

A further supporting panel 48 is arranged between the supporting panels 4, 5 and is pivotable about a pivot axis 49 with respect to the frame section 41, 42, 45, namely by virtue of the fact that the panel 48 is articulated to the frame sections 43, 44, 46 by way of inclined guide rods or the like 51 hingedly mounted about a pivot axis 50 in the central area of this further panel. The supporting panel rests on stops or abutments disposed in the area designated by the reference numeral 52. When the lower supporting panel is lifted, the panels 4, 48 are likewise lifted so that the shelf arrangement can be quickly collapsed in the manner described hereinabove. The inclined guide rods 51 essentially correspond to the guide rods 23 of the embodiment illustrated in FIG. 4.

Figure 10:
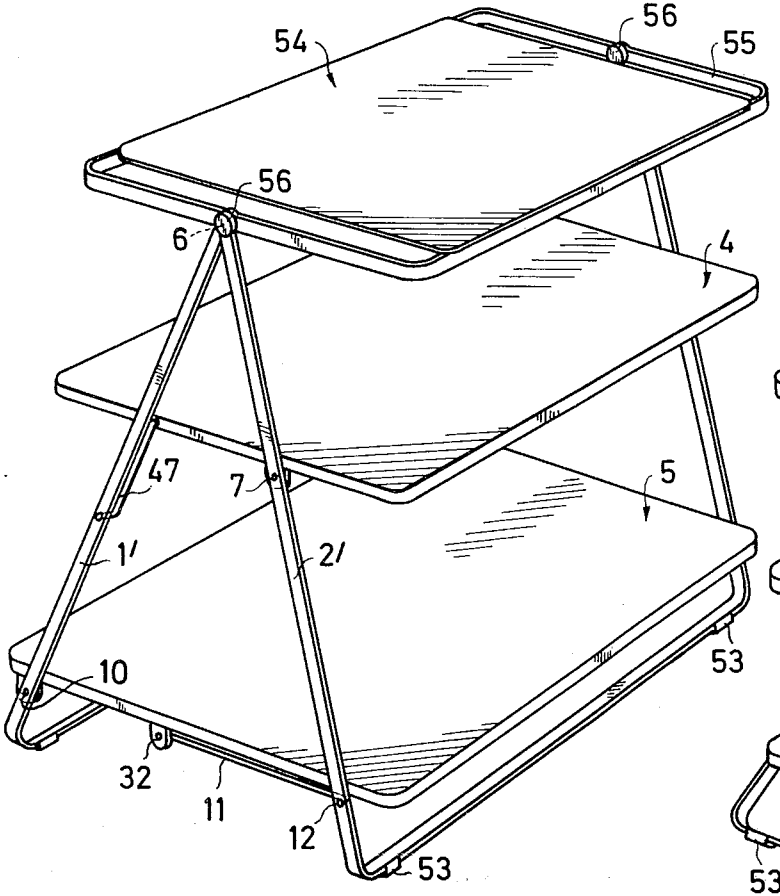
FIG. 10 is a perspective view of a shelf arrangement according to the present invention with a tray-type table top.

In a further embodiment of the present invention illustrated in FIG. 10, frame sections 1′, 2′ of the arrangement shown in FIG. 7 are provided with extensions 53 in lieu of the rollers or casters 3. As shown in FIG. 10, the supportinng panel 4 is articulated to the frame section 1′ by way of guide rods or the like 47 and the supporting panel 5 is joined by way of guide rods 11. A further supporting panel 54 is provided in the zone of the pivot axis 6 of the frame sections 1′, 2′ with this further supporting panel being affixed to the frame 55 as a table top. Conventional releasable joints 56 are employed to lock the further supporting panel or tray 54 in position. These joints 56 must be unlocked before a set-up shelf is folded or collapsed and are automatically locked when a collapsed shelf is set up. Of course it is understood that the table top or the like formed by the supporting panel or tray 54 should not be loaded excessively so that the joints 56 are not unduly stressed.

Figure 11:
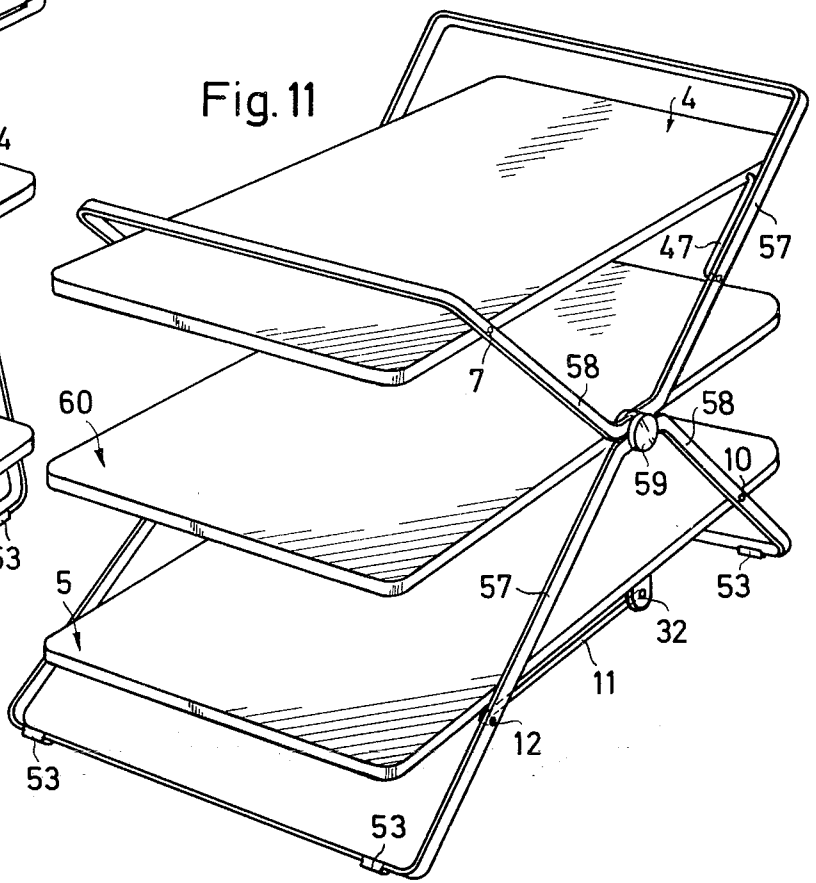
FIG. 11 is a perspective view of an embodiment of the present invention with frame sections having a substantially X-shape in the set-up condition.
Figure 12:
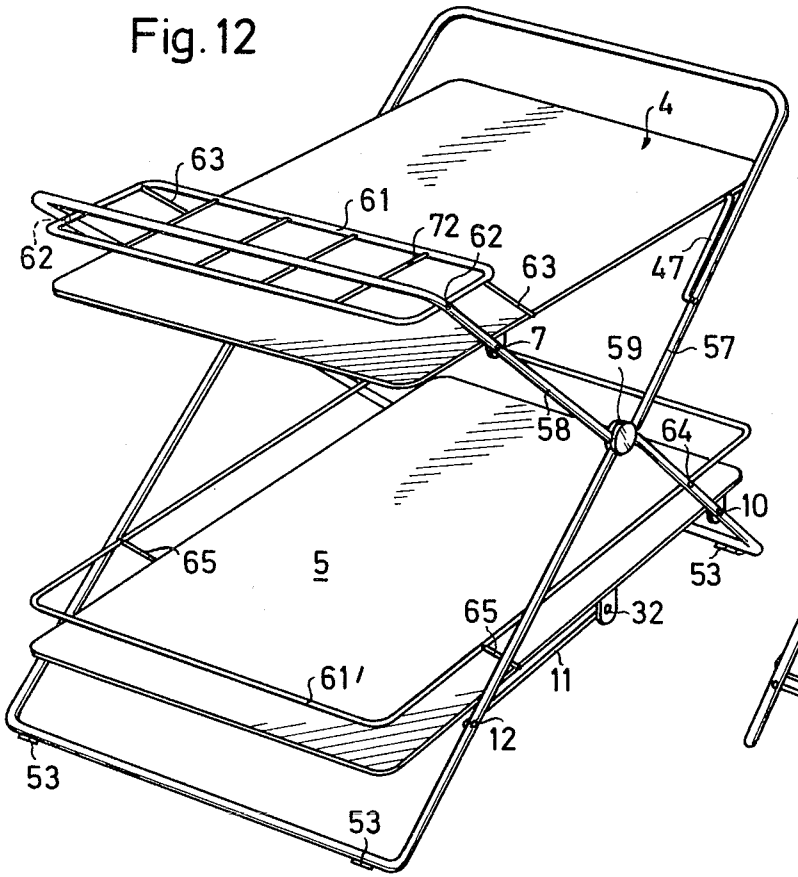
FIG. 12 is a perspective view of a further modification in accordance with the present invention with frame sections oriented similarly to FIG. 11 and with an additional frame section.

The embodiments illustrated in FIGS. 11 and 12 demonstrate the application of the principles of the present invention to the conventional structure disclosed in the aforementioned German Utility Model No. 6,919,448. As shown in these figures, each frame section 57, 58, respectively, consists of a type of frame with a bent portion in the zone of the joints 59 which forms the pivot axis for the shelf arrangement. Each frame section consists of two tubes or the like bent in a substantially U-shape with the leg ends being attached to the appropriate points at the joints 59. The supporting panel 4 is disposed above the axis of the joints 59 and is pivotally mounted to the frame section 58 along pivot axis 7. The supporting panel 4 is articulated to the frame section 57 by way of guide rods 47, whereas the supporting panel 5 is disposed beneath the pivot axis of the joints 59. The supporting panel 5 is pivotable about the pivot axis 10 and is articulated to the frame section 57 by way of guide rods 11. A further supporting panel or tray 60 is pivotably arranged between the two supporting panels 4, 5 and locked in a horizontal position by the joints 58 which correspond essentially to the joints 56 of FIG. 10. As with the embodiment of FIG. 10, the supporting panel or tray 60 should not be burdened by an excessive load to avoid unduly stressing the joints 59.

Figure 13:
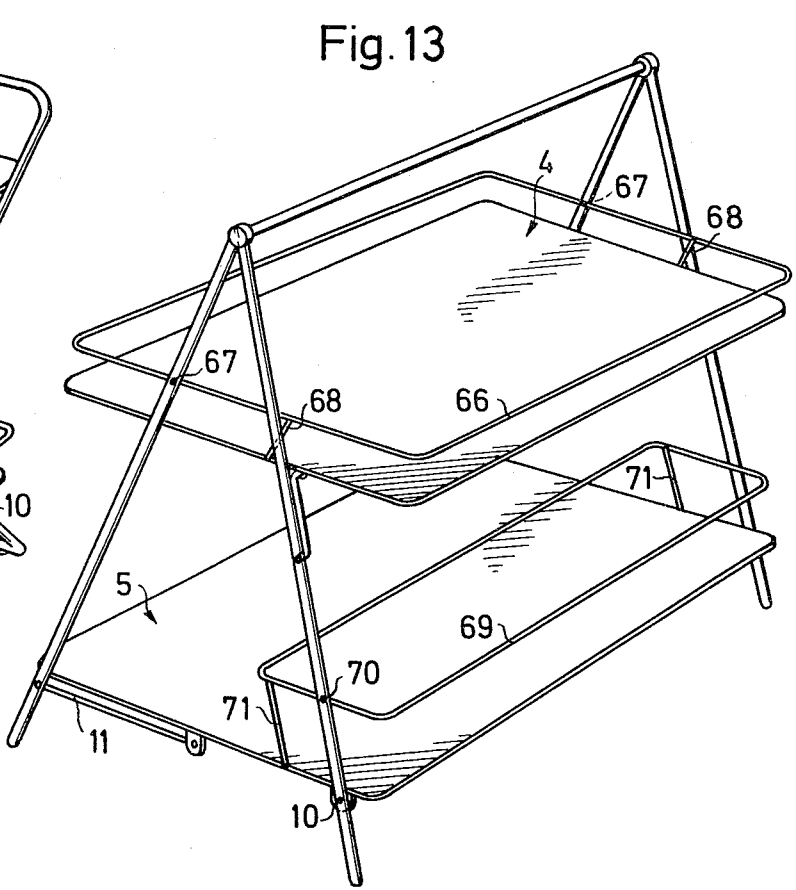
FIG. 13 is a perspective view of a shelf arrangement according to the present invention similar to the arrangement of FIG. 7 with an additional frame section.

As shown in FIGS. 12 and 13, the supporting panels 4, 5, articulated in the same manner as the supporting panels 4, 5, of the embodiment of FIG. 11, can be equipped with suitable attachments.

As shown in FIG. 12, the supporting panel 4 is associated with a frame member 61 which is pivotable about a pivot axis 62 and is articulated to the panel 4 by means of guide rods 63 so that the frame 61 is pivoted together with the panel 4 when the shelf arrangement is collapsed. Disposed above the supporting panel 5 is a further frame member 61′ which is mounted to be pivotable about the pivot axis 64 and is joined to the supporting panel 5 by way of guide rods 65. Consequently, the frame 61′ is also pivoted when the supporting panels 4 and 5 are pivoted. By the arrangement of FIG. 12, it is possible thereby to place articles on the supporting panels 4, 5 so they cannot fall off these panels when the shelf arrangement is being moved. Additionally, as shown in FIG. 12 the frame member 61 may be provided with a plurality of cross pieces 72 dividing such member into a plurality of compartments.

FIG. 13 illustrates a similar construction to FIG. 12 wherein the supporting panel 4 is associated with a frame 66 and is pivotable about the pivot axis 67 and articulated to the frame by guide rods 68. A somewhat smaller frame 69 is associated with the supporting panel 5 which is pivotable about the pivot axis 70 and articulated to the panel 5 by guide rods 71. As apparent from the arrangement of FIG. 13, upon collapsing of the shelf arrangement the frame members 66, 69 are pivoted about their respective pivotal axis when the supporting panels 4, 5 are pivoted.

As readily apparent to one skilled in the art any suitable conventional fastening means such as rivets, screws, bolts or the like may be employed to interconnect the various elements of the present invention to permit their pivotal movement.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are emcompassed by the scope of the appended claims.

I claim:

1. A collapsible shelf arrangement comprising: at least two frame means for supporting the shelf arrangement, means for mounting said frame means to be pivotable with respect to each other, at least two supporting panel means, means for pivotally mounting each of said supporting panel means to said frame means, said supporting panel means being pivotable between collapsed and opened positions, a first locking means provided on one of said supporting panel means for automatically locking the same when said supporting panel means is pivoted to its opened position, a second locking means provided on the other of said supporting panel means for locking the same in the open position, said first and second locking means being operatively connected whereby said second locking means is releasable only once said supporting panel means associated with said first locking means has been pivoted toward the collapsed position.

2. An arrangement according to claim 1, wherein means are provided on said frame means for supporting said supporting panel means in the open position.

3. An arrangement according to claim 2, wherein one of said supporting panel means is pivotally mounted on one of said frame means and the other of said supporting panel means is pivotally mounted on the other of said frame means, said supporting panel means in the open as well as in the collapsed position being disposed in substantially parallel planes.

4. An arrangement according to claim 3, wherein said first locking means includes a pair of guide rod means, and means for pivotally connecting respective ends of said guide rod means to the associated supporting panel means and said frame means.

5. An arrangement according to claim 4, wherein said pair of guide rod means is pivotally connected to said frame means other than the frame means pivotally supporting the associated supporting plate means.

6. An arrangement according to claim 4, wherein said second locking means includes a linear guide means fixedly disposed on the associated supporting panel means, and means provided on said frame means for engaging said linear guide means for guiding the displacement of the associated supporting panel means.

7. An arrangement according to claim 6, wherein said last-mentioned means includes bolts mounted on said frame means other than the frame means supporting the associated supporting plate means.

8. An arrangement according to claim 7, wherein further guide rod means are provided for mounting said bolt means on the frame means, one end of said further guide rod means carrying said bolt means and the other end of said further guide rod means being pivotally connected to said frame means, said further guide rod means in the open position being disposed substantially parallel to the frame means to which it is connected.

9. An arrangement according to claim 4, wherein said second locking means includes a further pair of guide rod means, and means for pivotally connecting the respective ends of said guide rod means to the associated supporting panel means and said frame means.

10. An arrangement according to claim 9, wherein said further pair of guide means is pivotally connected to said frame means other than the frame means pivotally supporting its associated supporting plate means, said further pair of guide means being disposed on said last-mentioned frame means to extend substantially parallel thereto with its associated supporting panel means in the open position.

11. An arrangement according to claim 3, wherein additional supporting panel means are provided, and means are provided for pivotally mounting said additional supporting panel means to said frame means.

12. An arrangement according to claim 11, wherein said first locking means includes a pair of guide rod means, and means for pivotally connecting the respective ends of said guide rod means to the associated supporting panel means and said frame means.

13. An arrangement according to claim 12, wherein said pair of guide rod means is pivotally connected to the frame means other than the frame means pivotally supporting the associated supporting plate means.

14. An arrangement according to claim 13, wherein said second locking means includes a linear guide means fixedly disposed on the associated supporting panel means, and means are provided on said frame means engaging said linear guide means for guiding the displacement of the associated supporting panel means.

15. An arrangement according to claim 14, wherein said last-mentioned means includes bolts mounted on said frame means other than the frame means supporting the associated supporting plate means.

16. An arrangement according to claim 15, wherein guide means are provided for connecting one of said at least two supporting panel means with said additional supporting panel means.

17. An arrangement according to claim 16, wherein said last-mentioned guide means includes cable means extending between said additional supporting panel means and said one of said at least two supporting panel means.

18. An arrangment according to claim 11, wherein said additional supporting panel means are pivotally supported on the same frame means and guide means are provided for connecting said additional panel means with the other of said frame means.

19. An arrangement according to claim 11, wherein means are provided for connecting at least two of said supporting panel means to each other for simultaneous displacement.

20. An arrangement according to claim 3, wherein the pivot axis of said frame means is disposed above said at least two supporting plate means, and wherein at least one additional supporting panel means is provided, and means are provided for mounting said additional supporting panel means substantially in the pivot axis of said frame means including means for locking said additional supporting panel means in position when said at least two supporting panel means are disposed in the open position.

21. An arrangement according to claim 20, wherein said first locking means includes a pair of guide rod means, and means for pivotally connecting respective ends of said guide rod means to the associated supporting panel means and said frame means.

22. An arrangement according to claim 21, wherein said pair of guide rod means is pivotally connected to the frame means other than the frame means pivotally supporting the associated supporting plate means.

23. An arrangement according to claim 22, wherein said second locking means includes a further pair of guide rod means, and means for pivotally connecting the respective ends of said further pair of guide rod means to the associated supporting panel means and to the frame means other than the frame means pivotally supporting the associated supporting plate means.

24. An arrangement according to claim 3, wherein each of said frame means consists of a frame member defining a polygon with said supporting panel means being pivotally mounted to said frame members at positions thereof within the confines of said polygon, each of said frame members being disposed such that they intersect with one another to form a substantially X-shaped configuration in a lateral view when the shelf arrangement is in the open position, and wherein means are provided for joining said frame members at their point of intersection, one of said supporting panel means being disposed on said frame members above said joining means and the other of said supporting panel means being disposed on said frame members below said joining means.

25. An arrangement according to claim 24, wherein said first locking means includes a pair of guide rod means, and means for pivotally connecting respective ends of said guide rod means to the associated supporting panel means and said frame means.

26. An arrangement according to claim 25, wherein said pair of guide rod means is pivotally connected to the frame means other than the frame means pivotally supporting the associated supporting plate means.

27. An arrangement according to claim 26, wherein said second locking means includes a further pair of guide rod means, and means for pivotally connecting respective ends of said further pair of guide rod means to the associated supporting panel means and to the frame means other than the frame means pivotally supporting the associated supporting plate means.

28. An arrangement according to claim 27, wherein at least one additional supporting panel means is provided, means are provided for pivotally mounting said additional panel means at said joining means, and wherein said joining means includes means for locking said additional supporting panel means in position when the other supporting panel means are disposed in the open position.

29. An arrangement according to claim 24, wherein attachments are provided for each of said at least two supporting panel means, means are provided for pivotally mounting said attachments to one of said frame members, and means are provided for pivotally connecting each of said attachments to a respective supporting panel means whereby said attachments are displaced from collapsed and open positions in response to the movement of said supporting panel means.

30. An arrangement according to claim 29, wherein said means for pivotally connecting said attachments include guide rod means with respective ends thereof being pivotally connected to the associated supporting panel means and said attachments.

31. An arrangement according to claim 30, wherein said attachments include pivotally mounted polygonally-shaped frames, at least one of said polygonally shaped frames being provided with a plurality of cross bars to divide the same into a plurality of individual compartments.

32. An arrangement according to claim 3, wherein attachments are provided for each of said at least two supporting panel means, means are provided for pivotally mounting said attachments to one of said frame means, and means are provided for pivotally connecting each of said attachments to a respective supporting panel means whereby said attachments are displaced from collapsed and open positions in response to the movement of said supporting panel means.

33. An arrangement according to claim 32, wherein said means for pivotally connecting said attachments include guide rods the respective ends of which are connected to said attachments and to a respective supporting panel means.

34. An arrangement according to claim 33, wherein said first locking means includes a pair of guide rod means, and means for pivotally connecting the respective ends of said pair of guide rod means to the associated supporting panel means and said frame means.

35. An arrangement according to claim 34, wherein said pair of guide rod means is pivotally connected to the frame means other than the frame means pivotally supporting the associated supporting plate means.

36. An arrangement according to claim 35, wherein said second locking means includes a further pair of guide rod means, and means for pivotally connecting the respective ends of said further pair of guide rod means to the associated supporting panel means and to the frame means other than the frame means pivotally supporting the associated supporting plate means.

37. An arrangement according to claim 1, wherein means are provided for movably supporting the shelf arrangement, said last-mentioned means being disposed on said frame means.

38. An arrangement according to claim 37, wherein said first locking means includes a pair of guide rod means and means for pivotally connecting the respective ends of said guide rod means to the associated supporting panel means and to the frame means other than the frame means supporting the associated supporting plate means, and wherein said second locking means includes a linear guide means fixedly disposed on the associated supporting panel means, and means provided on said frame means engaging said linear guide means for guiding the displacement of the associated supporting panel means.

* * * * *